US006879800B2

(12) United States Patent
Mabuchi et al.

(10) Patent No.: US 6,879,800 B2
(45) Date of Patent: Apr. 12, 2005

(54) DEVELOPING APPARATUS AND ELECTROSTATIC RECORD APPARATUS

(75) Inventors: Hiroyuki Mabuchi, Ibaraki (JP); Masayoshi Ishii, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 12 days.

(21) Appl. No.: 10/321,671

(22) Filed: Dec. 18, 2002

(65) Prior Publication Data

US 2003/0185600 A1 Oct. 2, 2003

(30) Foreign Application Priority Data

Mar. 29, 2002 (JP) ..... P2002-097262

(51) Int. Cl.[7] ..... G03G 15/09
(52) U.S. Cl. ..... 399/269; 399/276; 399/277
(58) Field of Search ..... 399/252, 265, 399/267, 268, 269, 276, 277

(56) References Cited

U.S. PATENT DOCUMENTS 5,239,343 A * 8/1993 Sakemi et al. ..... 399/275
6,330,415 B1 * 12/2001 Imamura et al. ..... 399/277
6,668,147 B1 * 12/2003 Ikeguchi ..... 399/277

FOREIGN PATENT DOCUMENTS

JP 07044021 * 12/1995
JP 8-87173 * 4/1996

* cited by examiner

*Primary Examiner*—Hoah Tran
(74) *Attorney, Agent, or Firm*—McGinn & Gibb, PLLC

(57) ABSTRACT

A position where a transport amount regulation member is opposed to a developing roller is in an area wherein the magnetic flux density in the tangent line direction becomes 95% or less of the maximum value upstream in the developer transport direction from the position at which the magnetic flux density in the normal direction formed by two magnetic poles on both sides of the transport amount regulation member on the sleeve roller surface of the developing roller becomes 0 gausses and is in an area wherein the magnetic flux density in the normal direction becomes 90% or less of the maximum value of the upstream pole in the developer transport direction.

18 Claims, 3 Drawing Sheets

DEVELOPING APPARATUS AND ELECTROSTATIC RECORD APPARATUS

BACKGROUND OF THE INVENTION

1. Field of the Invention

This invention relates to an electrostatic record apparatus such as an electrophotographic printer or copier and in particular to a developing apparatus and an electrostatic record apparatus using a magnetic developer.

2. Description of the Related Art

FIG. 6 is a schematic drawing of an electrophotographic record apparatus using a developing apparatus in a related art. A developing apparatus 4 has two developing rollers 31*a* and 31*b* at positions opposed to a photo conductor 1, transport rollers 35*a* and 35*b* for transporting a developer 20 to the developing rollers 31*a* and 31*b*, and a transport amount regulation member 33 for regulating the transport amount to a predetermined amount. The developing apparatus 4 scrubs and develops an electrostatic latent image uniformly charged by a charger 2 and then exposed to light in a light exposure unit 3 in response to image information and formed on the photoconductor 1 in a developing area 40 in the developer 20 of a mixture of toner 21 and carrier 25 on the developing roller 31.

Next, an electric field in the move direction of the toner 21 to a record medium 8 is formed by a transfer unit 7 and the toner 21 on the photoconductor 1 is transferred to the record medium 8. When the record medium 8 on which the toner 21 is deposited passes through a fuser 9, it is heated and pressurized and the toner 21 is fused and fixed onto the record medium 8. The remaining toner 21 or adherents of paper powder, etc., on the photoconductor 1 after transfer part passage are separated and removed from the photoconductor 1 by a cleaning unit 11 and are collected.

Next, the operation of the developing apparatus 4 will be discussed with FIG. 5. In the developing apparatus 4, the two developing rollers 31*a* and 31*b* each comprising a rotatable sleeve roller 32 (32*a*, 32*b*) on the outer periphery of a fixed magnet 30 (30*a*, 30*b*) are opposed to each other with the transport amount regulation member 33 between. In the developing roller 31*a*, the sleeve roller 32*a* rotates clockwise in FIG. 5, namely, in a direction in which the developer 20 moves in the opposite direction to the move direction of the photoconductor 1 in a developing area 40*a* (reverse rotation).

In the developing roller 31*b*, the sleeve roller 32*b*rotates counterclockwise in FIG. 5, namely, in a direction in which the developer 20 moves in the same direction as the move direction of the photoconductor 1 in a developing area 40*b* (forward rotation).

The developer 20 agitated by an agitation section (not shown) and transported to the proximity of the developing roller 31*b*is magnetically attracted to the surface of the sleeve roller 32*b* by the magnetic force of an N1 pole of the magnet 30*b* in the developing roller 31*b*, and as the sleeve roller 32*b* rotates, the developer 20 is transported to an S1 pole.

The transport amount regulation member 33 is placed with the spacing adjusted between a transport amount regulation part 34*b* and the sleeve roller 32*b*. The transport amount of the transported developer 20 is regulated according to the spacing between the transport amount regulation part 34*b* and the sleeve roller 32*b*, which will be hereinafter referred to as doctor gap, as the sleeve roller 32*b* rotates, and a given amount of the developer 20 passing through the transport amount regulation part 34*b* arrives at the developing area 40*b*.

The developer 20 whose transport amount is regulated according to the doctor gap is transported from the S1 pole to an N2 pole further as the sleeve roller 32*b* rotates, and forms a magnetic brush by a magnetic field produced by the N2 pole and its surrounding pole in the developing area 40*b* and scrubs the photoconductor 1. The doctor gap is set so that the transport amount of the developer 20 becomes a proper value relative to the spacing between the photoconductor 1 and the sleeve roller 32, which will be hereinafter referred to as developing gap, so that the developer 20 does not disorder the developed image by excessively scrubbing the photoconductor 1 or so that sufficient print density can be provided because of sufficient transport amount relative to the developing gap.

The developer 20 that cannot pass through the transport amount regulation part 34*b* gets over the transport amount regulation member 33, is transported to the developing roller 31*a*, and is regulated so that the transport amount of the developer 20 becomes constant according to the spacing between a transport amount regulation part 34*a* and the sleeve roller 32*a*. The developer 20 passing through the transport amount regulation part 34*a* is transported to the developing area 40*a*.

The developer 20 that cannot pass through the transport amount regulation part 34*a* either is returned to the agitation part by a scraper. The developer 20 transported to the developing area 40*b* by the sleeve roller 32*b* and completing the developing is transported with rotation of the sleeve roller 32*b* and is returned to the transport roller 35*a*.

The developer 20 transported to the developing area 40*a* by the sleeve roller 32*a* and completing the developing is transported with rotation of the sleeve roller 32*a* and is returned to the agitation part by the scraper.

Thus, the developing apparatus of the type wherein the two developing rollers are opposed to each other with the transport amount regulation member 33 between and transport the developer in the opposite directions is called center feed type developing machine. The configuration wherein three or four rollers are included rather than the configuration wherein only two rollers are included as in the example is also available.

It is necessary to develop a developing system which is capable of performing high-density print in an electrophotographic record apparatus for printing according to the process as described above and provides high resolution and is small at low cost with no carrier deposition.

In the developing apparatus, toner is deposited on an electrostatic latent image formed on the photoconductor, whereby the latent image needs to be developed with good reproducibility. The amount of the developer transported to the developing area is an important factor to provide the optimum image quality. To faithfully reproduce the latent image in the developing apparatus using a dual-component developer, the case increases where the developing gap is set narrow to 0.6 mm or less and the developer amount to be transported is also set small so as to eliminate defective conditions of scraping, etc., occurring because the developer amount is too much.

However, to transport a proper amount of the developer to the narrow developing gap, the doctor gap needs also to be set narrow in response to the developing gap, and must be made a very narrow gap of 0.4 mm or less in some cases.

To develop in a narrow developing gap, if the amount of the developer transported to the developing area varies, a defective condition on the image quality such as inconsistencies in density easily occurs. It is difficult to set such a narrow doctor gap over all area in the developing roller shaft direction with good accuracy. Particularly to use a 400 mm or more long developing roller to perform wide print or to use a small-diameter roller to miniaturize the developing apparatus, a problem of a different transport amount from one location on the roller to another easily occurs.

Variations in dimensions of the developing roller, the transport amount regulation member, etc., because of a manufacturing error cannot be avoided and it takes much time in adjustment at the assembling time. Moreover, the transport amount of even the developing roller set in the appropriate range by adjustment changes with abrasion of the sleeve roller surface and thus if the roller formed on the surface with asperities by shot blast or metal shot for enhancing the transport capability is worn by secular changes, a problem of changing the transport amount and degrading the image quality easily occurs.

The center feed type developing machine has a pair of rollers different in photoconductor scrubbing direction in the developer and thus has the advantage that defective conditions of chips, etc., in the image end parts by scrubbing on the rollers cancel each other out and the developing machine can perform print of high image quality with less chips of the image end parts. When the transport amount regulation member positioned in the gap between both rollers regulates the amount of the developer transported to the developing areas of both rollers, both developing rollers are placed close to each other and thus developer transport to the transport amount regulation member or the regulation state varies more easily because of a manufacturing error or a fix position error of the developing rollers or the transport amount regulation member as compared with a developing apparatus using one developing roller; this is a problem. Higher assembling accuracy of the developing apparatus than that of the usual developing apparatus is required.

SUMMARY OF THE INVENTION

The invention is intended for solving the problems described above and in a developing apparatus using one developing roller or a center feed type developing apparatus using two or more developing rollers, the position where a transport amount regulation member is opposed to the developing roller is in an area wherein the magnetic flux density in the tangent line direction becomes 95% or less of the maximum value upstream in the developer transport direction from the position at which the magnetic flux density in the normal direction formed by two magnetic poles on both sides of the transfer amount regulation member on the sleeve roller surface of the developing roller becomes 0 gausses and is in an area wherein the magnetic flux density in the normal direction becomes 90% or less of the maximum value of the upstream pole in the developer transport direction.

DETAILED DESCRIPTION OF THE PREFERRED EMBODIMENTS

Figure 1:
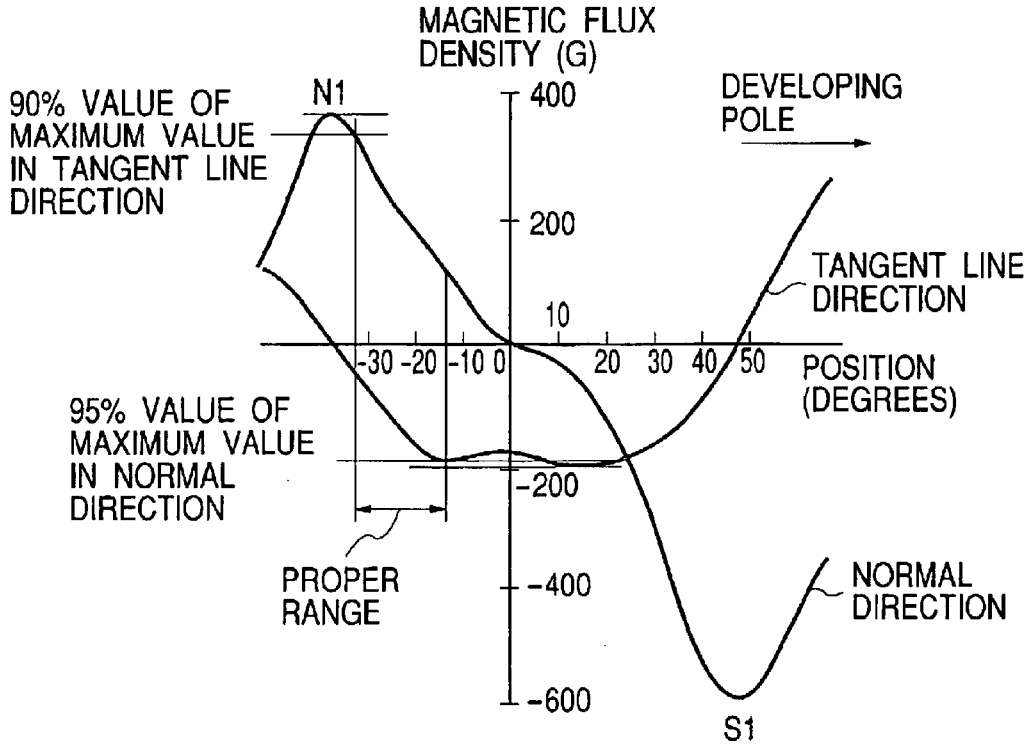
FIG. 1 is a schematic representation to show the relationship between the magnetic flux density distributions of a developing roller and the installation positions of a transport amount regulation part in the invention.

Embodiments of the invention will be discussed in detail with reference to the accompanying drawings.

Considering motion of a developer in a transport amount regulation part, the developer transported to the transport amount regulation part attempts to pass through a doctor gap with rotation of a sleeve roller, but the doctor gap is narrow as compared with the transported developer amount and thus the surface developer is scraped off and only the developer passing through the doctor part is transported.

At this time, a magnetic attraction force onto the sleeve roller acts on the carrier in the developer and a frictional force with the sleeve roller acts on the developer directly coming in contact with the sleeve roller of the bottom layer. Thus, the developer on the sleeve roller attempts to pass through the transport amount regulation part as the sleeve roller rotates. At the time, the developer acts so as to allow also the magnetically attracted surrounding carrier to pass through the doctor part and is compressed in the doctor part.

Generally, if the developer passage amount is regulated with the developer compressed to some extent, the regulated amount less varies and thus often the transport amount regulation part is formed with a taper part so as to become narrower in the travel direction of the developer and often the transport amount regulation part regulates the transport amount of the developer with the developer compressed as compared with the point in time at which the developer was previously transported on the sleeve roller.

Hitherto, often the position of the transport amount regulation part has been set to a position where the vertical direction magnetic flux density formed by magnetic poles placed on both sides of the transport amount regulation part becomes 0 gausses. However, according to the examination of the inventor et al., it turned out that when the developer amount is regulated according to the doctor gap so that it becomes a proper developer amount in the developing area, if the same amount of the developer is passed through, because of variations in the magnetization pattern of a magnet or the positional relationship between the magnet and the transport amount regulation part, abrasion of the sleeve roller surface, etc., the developer amount after regulated may vary drastically or the developer may be able to be regulated comparatively stably with the less effects.

Particularly, if the developing gap is set narrow to perform print of high image quality and the doctor gap is set narrow, particularly to 0.6 mm or less to transport a proper amount of the developer to the developing area relative to the developing gap, it turned out that the developer may be unable to pass through the transport amount regulation part and the amount of the developer transported to the developing area may lower drastically and it may be made impossible to obtain a necessary transport amount of the developer although a sufficient spacing to allow the developer to pass through is provided depending on the positional relationship between the transport amount regulation part and the magnet.

Figure 3:
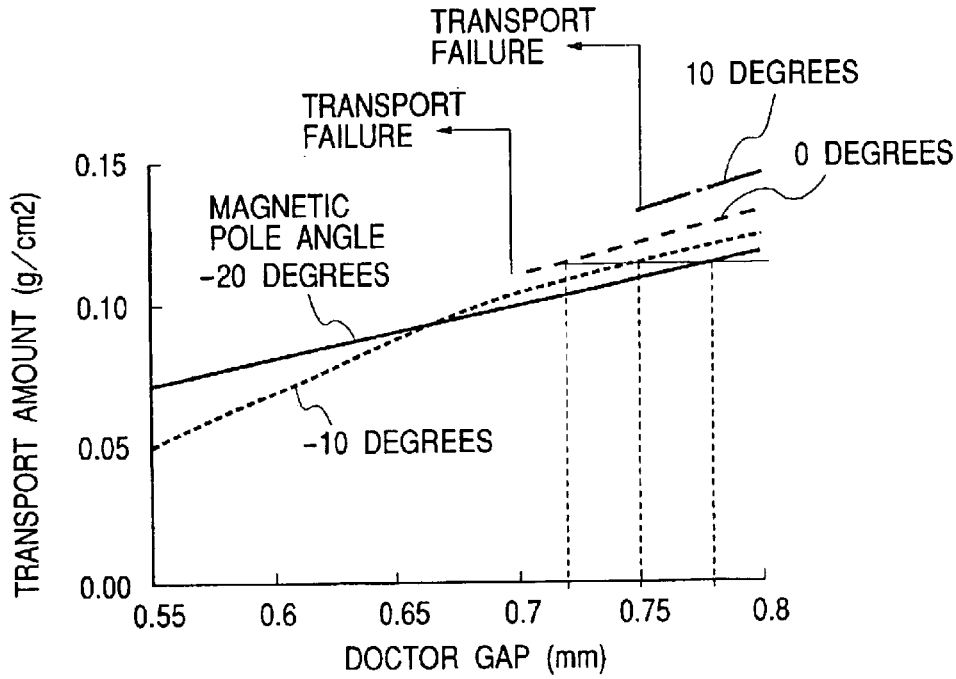
FIG. 3 is a schematic representation to show the developer transport amount measurement result when the transport amount regulation part position and a doctor gap are changed.

FIG. 3 is a drawing to show the developer transport amount measurement result when the transport amount regulation part position and the doctor gap are changed and the measurement result in a developing machine using a developing roller 20 mm in diameter with the surface of a sleeve roller treated by sand blast. The transport amount indicates the deposition amount of the developer 20 per unit area of the sleeve roller 32 by sampling the developer 20 on the sleeve roller 32 after passing through the transport amount regulation part 34.

Figure 4:
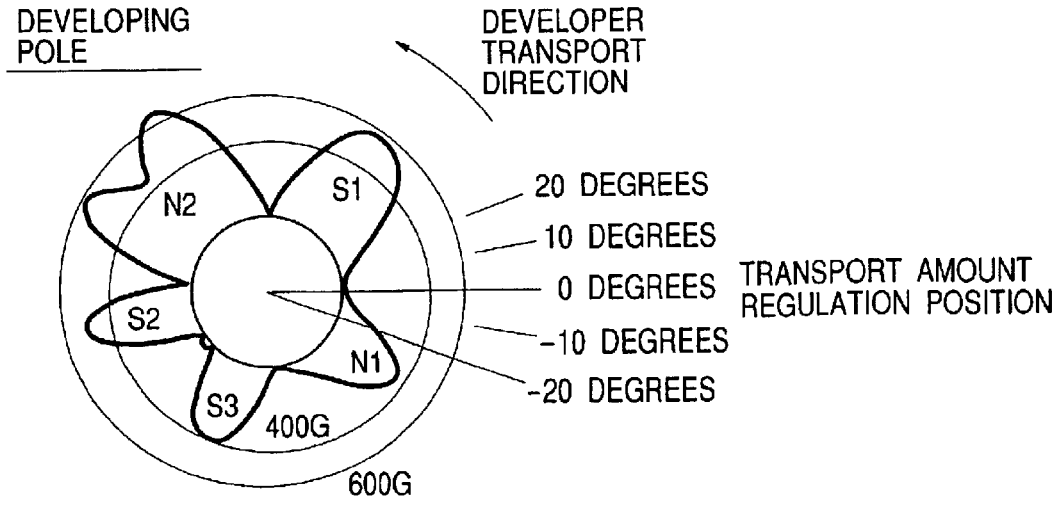
FIG. 4 is a schematic representation to show the magnetic flux density distribution in the normal direction measured on the sleeve roller surface of a developing roller.
Figure 5:
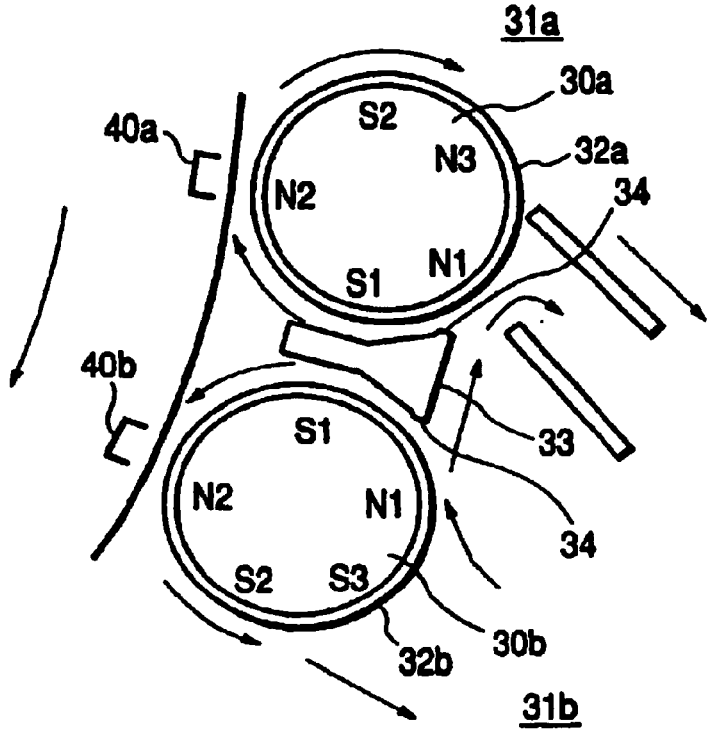
FIG. 5 PRIOR ART
FIG. 5 is a schematic drawing to show the operation of developing apparatus.
Figure 6:
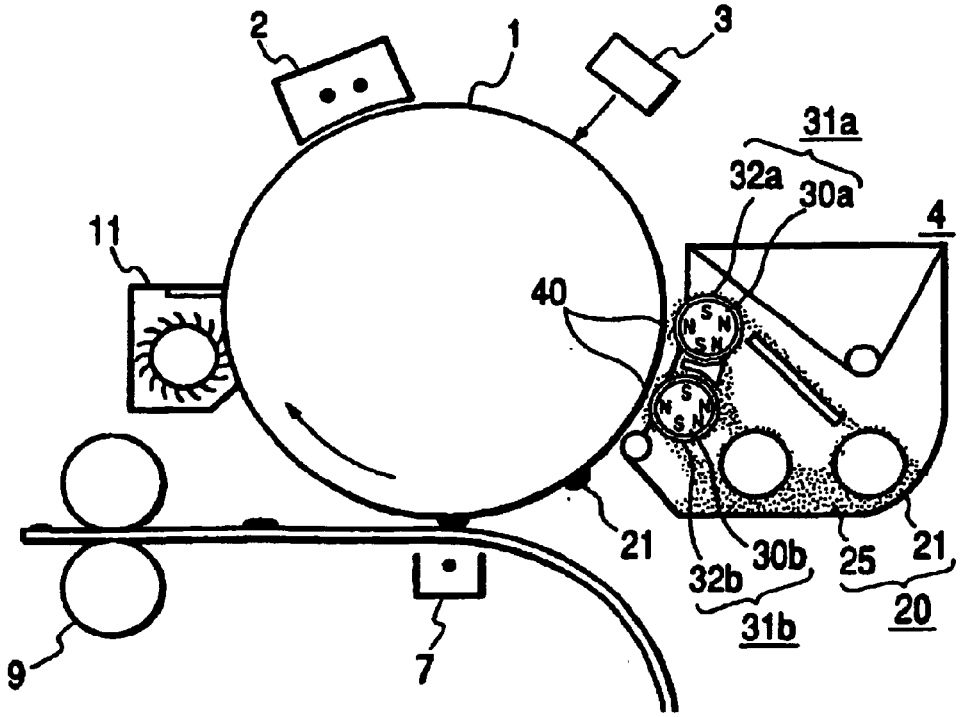
FIG. 6 PRIOR ART
FIG. 6 is a schematic drawing to show the configuration of a related art example.

The magnetic flux density distribution in the normal direction, found by measurement on the sleeve roller surface of the developing roller is as shown in FIG. 4; the transport amount regulation part is opposed to the sleeve roller between N1 pole and S1 pole.

As the sleeve roller rotates, the developer moves counterclockwise as indicated by the arrow in the figure. The position of the transport amount regulation part at which the vertical direction magnetic flux density on the sleeve roller surface becomes 0 is 0 degrees as the reference, the developer transport direction from the reference position is +, and the opposite direction is −. Measurement was conducted as the transport amount regulation part position was changed in the range of −20 degrees to +10 degrees with the developing roller shaft as the center.

The used developer is a mixture of ferrite carrier coated with silicon having a volume average particle diameter of 90 $\mu$m and styrene acrylic toner having a volume average particle diameter of 8 $\mu$m in toner concentration 4%.

From FIG. 3, at the magnetic pole position 0 degrees at which the normal direction magnetic flux density on the sleeve roller surface becomes 0, as the doctor gap was narrowed, the transport amount rapidly was lowered and with the doctor gap 0.7 mm, a transport failure occurred (the developer does not pass through although a sufficiently wide gap is made as compared with the carrier particle diameter 90 $\mu$m).

At the magnetic pole angle 10 degrees as placement in which the transport amount regulation part is brought close to the S1 pole of the pole close to the developing area from the magnetic pole position at which the vertical direction magnetic flux density becomes 0, a transport failure occurred with wider doctor gap 0.75 mm.

However, at the magnetic pole angle −10 degrees as placement in which the transport amount regulation part is brought close to the N1 pole of the pole at a distance from the developing area, although the doctor gap was narrowed, a phenomenon in which the transport amount rapidly was lowered and it is made impossible for the developer to pass through a wider gap than the carrier particle diameter did not occur, but a phenomenon in which lowering of the transport amount becomes large was observed from the doctor gap of about 0.6 mm. In contrast, at the magnetic pole position −20 degrees, the relationship between the doctor gap and the transport amount was almost proportional relationship and although the doctor gap was set narrower than 0.6 mm, it was possible to transport the developer to the developing area and although the doctor gap was narrowed to 0.4 mm, the developer was able to be transported stably.

Further, the doctor gap when the transport amount becomes the same at each magnetic pole position can be set wider as the position of the transport amount regulation part 34 is brought closer to the upstream magnetic pole; for example, the doctor gap allowing the transport amount to become 0.11 g/cm$^2$ was 0.72 mm at magnetic pole position 0 degrees, 0.75 mm at magnetic pole position −10 degrees, and 0.78 mm at magnetic pole position −20 degrees. Moreover, variation of the transport amount when the doctor gap is changed also becomes smaller as the transport amount regulation position is closer to the upstream magnetic pole.

That is, it turned out that if the transport amount regulation position is set upstream from the position at which the magnetic flux density in the normal direction becomes 0, the doctor gap to obtain the same transport amount can be set wide and variation of the transport amount can be lessened if the doctor gap varies.

As a result of further making various examinations, it turned out that the phenomenon in which it is made impossible for the developer to pass through if the doctor gap is narrowed is largely affected by the magnetic field formed in the proximity of the transport amount regulation part by the magnetic poles placed on both sides of the transport amount regulation part.

The magnetic flux density in the normal direction and the magnetic flux density in the tangent line direction formed by the magnetic poles have the following relationship: The magnetic flux density in the tangent line direction reaches the maximum at the position at which the magnetic flux density in the normal direction becomes 0; the magnetic flux density in the tangent line direction becomes 0 at the position at which the magnetic flux density in the normal direction reaches the maximum. Since the force received by the particles in the magnetic field is determined by the absolute value and the inclination of the magnetic flux density, the magnetic flux density in the creepage direction reaches the maximum at the point at which the magnetic flux density in the vertical direction becomes 0 and the magnetic flux density in the creepage direction reaches the maximum. Because of no inclination, the state is an unstable state in which a move is made to neither magnetic pole direction substantially. If even a slight deviation occurs from the point at which the magnetic flux density in the creepage direction reaches the maximum, the force responsive to the inclination of the magnetic flux density in the creepage direction and the absolute value of the magnetic flux density at the point acts and attraction to the closer magnetic pole occurs.

Therefore, the force attempting to move the carrier in the creepage direction on the sleeve roller weakens at the point at which the magnetic flux density in the normal direction appearing at the magnetic pole direction and at the center of both magnetic poles becomes 0, the force acts in the direction attempting to move the carrier downstream at a downstream position in the developer transport direction from the position, and the force acts in the direction returning the developer upstream against the developer transport direction from the center position to an upstream position.

That is, it is considered that if the transport amount regulation part is set downstream from the center position of both magnetic poles, the force in which the carrier upstream from the transport amount regulation part magnetically attracts the carrier attempting to pass through the transport amount regulation part strengthens and the carrier is attracted to the carrier passing through the transport amount regulation part and moves toward the transport amount regulation part, so that the filling factor of the developer increases and blocking easily occurs.

On the other hand, as the transport amount regulation part is set in the upstream direction from the center position of both magnetic poles, the force in which the carrier passing through the transport amount regulation part magnetically attracts the surrounding carrier weakens and thus when the transport amount regulation part regulates a downstream move, magnetic attraction to the carrier passing through the transport amount regulation part is easily partitioned, so that blocking is hard to occur and the developer flow in the transport amount regulation part becomes stable.

Therefore, if the doctor gap is narrowed, it is possible to make hard to occur a phenomenon in which it is made impossible for the developer to pass through the transport amount regulation part because of blocking. However, if the regulation position is brought too close to the upstream magnetic pole, the magnetic force in the normal direction strengthens and the carrier extends along the magnetic force line in the normal direction in the proximity of the transport amount regulation part, namely, forms a magnetic brush.

The formation of the magnetic brush is a phenomenon in which the surrounding carrier concentrates on an area in which one condition is satisfied, and extends in the normal direction; of course, a portion in which the developer (carrier) comes into a magnetic brush and a portion in which the developer (carrier) does not come into the magnetic brush differ in the filling state of the developer. If the transport amount is regulated in this state, minute roughness or fineness occurs in the developer transport amount after regulated and although the developer is stably transported in a visual inspection, minute inconsistencies in density occur and granularity is degraded and therefore it was understood that the installation position of the transport amount regulation part involves a proper range.

As a result of making various examinations on the relationships among the magnetic flux density distributions in the normal direction and the tangent line direction of the N and S poles with the transport amount regulation part between and the installation position of the transport amount regulation part and the developer transportability, it turned out that the position where the transport amount regulation part is opposed to the developing roller is in an area wherein the magnetic flux density in the tangent line direction becomes 95% or less of the maximum value upstream in the developer transport direction from the position at which the magnetic flux density in the normal direction formed by the two magnetic poles on both sides of the transport amount regulation member on the sleeve roller surface of the developing roller becomes 0 gausses and is in an area wherein the magnetic flux density in the normal direction becomes 90% or less of the maximum value of the upstream pole in the developer transport direction, whereby if a narrow gap is set, the developer 20 can be regulated stably and the same transport amount can be provided in a comparatively wide gap and variation of the transport amount is also lessened if the gap varies, so that if the developing gap is set to a narrow gap of 0.6 mm or less, high-quality developing can be realized stably over a long term.

FIG. 1 is a drawing to snow as one embodiment of the invention the magnetic flux density distributions in the normal direction and the tangent line direction between the N1 pole and the S1 pole of the developing rollers with the transport amount regulation part between shown in FIG. 4 and the installation positions of the transport amount regulation part enabling stable developing without causing a transport failure or a print failure to occur if the doctor gap was set to a narrow gap of 0.6 mm or less as a result of checking the transportability and the print quality while the transport amount regulation position was changed in the developing gap range of 0.8 mm to 0.5 mm in various developers using the rollers with a center feed type developing machine. To measure the magnetic flux density distributions, gauss meter Model GM-5220 manufactured by Denshi Jiki Kougyou Kabushikikaisha was used. The measurement was conducted with no developer deposited on the sleeve roller surface. The magnetic flux density in the normal direction was measured in a state in which a probe was brought into intimate contact with the sleeve roller surface. The magnetic flux density in the circumferential direction was measured in a state in which a probe was brought into intimate contact with the sleeve roller surface. The magnetic flux density in the circumferential direction was measured in a state in which a probe was brought into intimate contact with the sleeve roller surface with the prove upright in the normal direction with the detection face directed in the circumferential direction.

The solid line in the figure indicates the magnetic flux density distribution in the tangent line direction and the dashed line indicates the magnetic flux density distribution in the normal direction. As the range in which stable developing can be performed, in the range in which the absolute value of the magnetic flux density in the tangent line direction between both magnetic poles becomes 95% or less of the maximum value (in the embodiment, minus side from −15 degrees) upstream in the developer transport direction from the position at which the magnetic flux density in the normal direction becomes 0 gausses between two poles (in the embodiment, N1 pole side), the transport amount became stable and print was able to be performed without occurrence of minute inconsistencies in density downstream from the position at which the magnetic flux density in the tangent line direction becomes 90% or less of the maximum value of the magnetic flux density of the upstream pole (in the embodiment, −33 degrees).

That is, the transport amount regulation part is opposed to the developing roller in an area wherein the magnetic flux density in the tangent line direction becomes 95% or less of the maximum value upstream in the developer transport direction from the position at which the magnetic flux density in the normal direction formed by the two magnetic poles on the sleeve roller surface and in an area wherein the magnetic flux density in the normal direction becomes 90% or less of the maximum value of the upstream pole in the developer transport direction, whereby if the developing gap is set to a narrow gap of 0.8 mm or less, it is made possible to transport the developer stably and it is made possible to perform high-quality print without any defects of minute inconsistencies in density, etc., in the print image quality.

Figure 2:
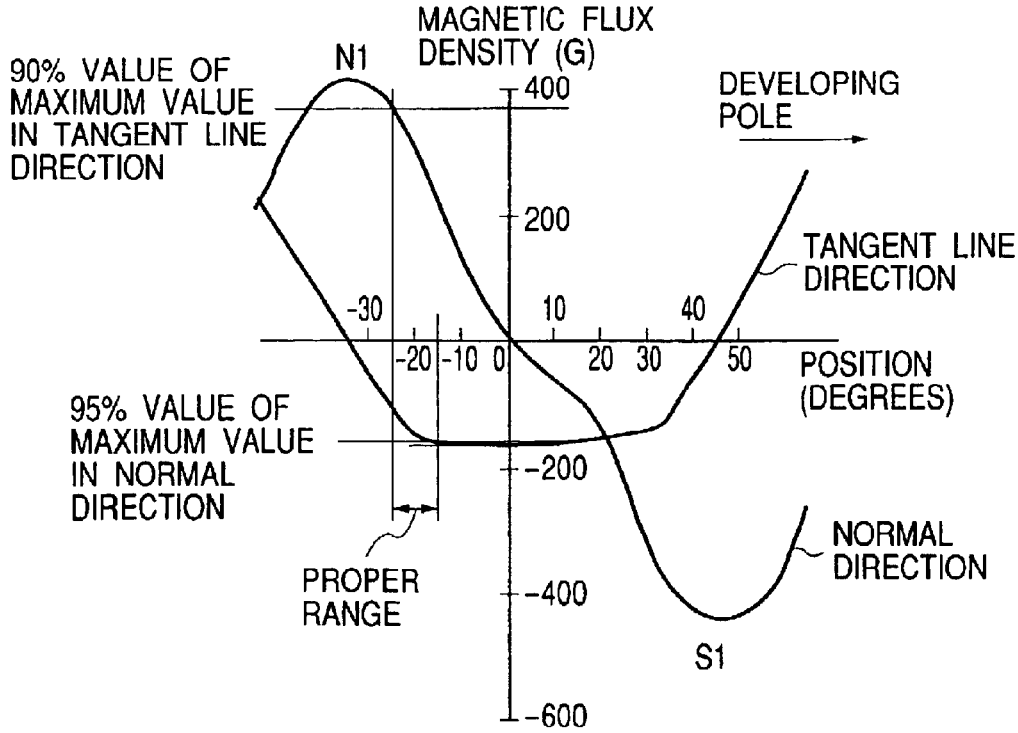
FIG. 2 is a schematic representation to show the relationship between the magnetic flux density distributions of a developing roller and the installation positions of a transport amount regulation part in another embodiment of the invention.

FIG. 2 shows the result of making similar examinations using a developing roller 36 mm in diameter with a different magnetization pattern from that of the roller in FIG. 4 corresponding to the print width 520 mm. The range in which the developer can be transported stably was the minus side from −15 degrees and no defect occurred in the image quality on the plus side from −25 degrees.

That is, as in FIG. 1, the transport amount regulation part is opposed to the developing roller in an area wherein the magnetic flux density in the tangent line direction becomes 95% or less of the maximum value upstream in the developer transport direction from the position at which the magnetic flux density in the normal direction formed by the two magnetic poles on the sleeve roller surface and in an area wherein the magnetic flux density in the normal direction becomes 90% or less of the maximum value of the upstream pole in the developer transport direction, whereby if the print width is wide (300 mm or more) and the developing gap is set to a narrow gap of 0.8 mm or less, it is made possible to transport the developer stably and high-quality print can be performed without any defects of minute inconsistencies in density, etc., in the print image quality.

Further, as a result of examining the developing gap and the used carrier particle diameter, it turned out that as the doctor gap becomes narrower relative to the carrier particle diameter, blocking at the transport amount regulation position occurs more easily and the developer is transported unstably. When the carrier particle diameter is Dc (mm) and the doctor gap is Dd (mm), the developer can be transported more stably by setting Dd/Dc>6.5.

According to the invention, there can be provided a small and low-cost developing apparatus that can transport a developer stably if the developing gap is set to a narrow gap, and an electrophotographic record apparatus of high print quality can be realized.

What is claimed is:

1. A developing apparatus comprising:

a developing roller having a fixed magnet having at least two magnetic poles different in polarity and a sleeve roller placed rotatably on the outer periphery of the magnet; and a developer regulation member being opposed to the developing roller between the two magnetic poles different in polarity, said developing apparatus for transporting a dual-component developer to a developing section for developing with rotation of the sleeve roller, wherein a position where the developer regulation member is opposed to the developing roller is in an area wherein the magnetic flux density in the tangent line direction becomes 95% or less of the maximum value upstream in the developer transport direction from the position at which the magnetic flux density in the normal direction formed by the two magnetic poles on the sleeve roller surface of the developing roller becomes 0 gausses and is in an area wherein the magnetic flux density in the normal direction becomes 90% or less of the maximum value of the upstream pole in the developer transport direction.

2. The developing apparatus as claimed in claim 1, wherein the spacing between a photoconductor and the developing roller is 0.8 mm or less.

3. The developing apparatus as claimed in claim 1, wherein said dual component developer includes a carrier wherein a volume average particle diameter of said carrier forming a part of the dual-component developer (Dc) and spacing between the developer regulation member and the sleeve roller (Dd) satisfies the relation Dd/Dc>6.5.

4. The developing apparatus as claimed in claim 1, further comprising:

at least two developing rollers, wherein the developer regulation member is placed between the two developing rollers and the two developing rollers are opposed to a photoconductor so that developing is first performed by the developing roller with the sleeve roller rotating in a direction in which the developer whose transport amount is regulated by the developer regulation member is transported in an opposite direction to the photoconductor move direction in a developing area and next developing is performed by the developing roller with the sleeve roller rotating in the direction in which the developer whose transport amount is regulated by the developer regulation member is transported in the same direction as the photoconductor move direction in a developing area.

5. An electrostatic record apparatus comprising a developing apparatus as claimed in claim 1.

6. A developing apparatus, comprising:

a developing roller including a magnet having magnetic poles different in polarity; and a developer regulation member being opposed to the developing roller between the magnetic poles different in polarity, said developing apparatus for transporting a developer to a developing section, wherein a position where the developer regulation member is opposed to the developing roller is in an area wherein a magnetic flux density in a tangent line direction becomes 95% or less of a maximum value upstream in a developer transport direction from a position at which a magnetic flux density in a normal direction formed by the magnetic poles of the magnet becomes 0 gausses.

7. The developing apparatus as claimed in claim 6, further comprising:

a sleeve roller disposed rotatably on an outer periphery of the magnet.

8. The developing apparatus as claimed in claim 6, wherein the spacing between a photoconductor and the developing roller is 0.8 mm or less.

9. The developing apparatus as claimed in claim 7, wherein a volume average particle diameter of carrier forming a part of the developer (Dc) and spacing between the developer regulation member and the sleeve roller (Dd) satisfies a relation Dd/Dc>6.5.

10. The developing apparatus as claimed in claim 7, further comprising:

at least two developing rollers wherein the developer regulation member is placed between the two developing rollers and the two developing rollers are opposed to a photoconductor.

11. The developing apparatus as claimed in claim 10, wherein developing is first performed by the developing roller with the sleeve roller rotating in a direction in which the developer whose transport amount is regulated by the developer regulation member is transported in an opposite direction to the photoconductor move direction in a developing area and next developing is performed by the developing roller with the sleeve roller rotating in the direction in which the developer whose transport amount is regulated by the developer regulation member is transported in the same direction as the photoconductor move direction in a developing area.

12. The developing apparatus according to claim 6, wherein the position where the developer regulation member is opposed to the developing roller is in an area wherein the magnetic flux density in the normal direction becomes 90% or less of the maximum value upstream in the developer transport direction.

13. An electrostatic record apparatus comprising a developing apparatus as claimed in claim 6.

14. The developing apparatus as claimed in claim 6, wherein said developer comprises a dual-component developer.

15. A method for developing an image on a record medium, comprising:

providing a developing roller having a fixed magnet having at least two magnetic poles different in polarity and a sleeve roller placed rotatably on the outer periphery of the magnet; and opposing a developer regulation member to the developing roller between the two magnetic poles different in polarity, said developing apparatus for transporting a dual-component developer to a developing section for developing with rotation of the sleeve roller, wherein a position where the developer regulation member is opposed to the developing roller is in an area wherein the magnetic flux density in the tangent line direction becomes 95% or less of the maximum value upstream in the developer transport direction from the position at which the magnetic flux density in the normal direction formed by the two magnetic poles on the sleeve roller surface of the developing roller becomes 0 gausses and is in an area wherein the magnetic flux density in the normal direction becomes 90% or less of the maximum value of the upstream pole in the developer transport direction.

16. The method as claimed in claim 15, wherein the spacing between a photoconductor and the developing roller is 0.8 mm or less.

17. The method as claimed in claim 15, wherein said dual component developer includes a carrier wherein a volume average particle diameter of said carrier forming a part of the dual-component developer (Dc) and spacing between the developer regulation member and the sleeve roller (Dd) satisfies the relation Dd/Dc>6.5.

18. The method as claimed in claim 17, further comprising:

at least two developing rollers, wherein the developer regulation member is placed between the two developing rollers and the two developing rollers are opposed to a photoconductor so that developing is first performed by the developing roller with the sleeve roller rotating in a direction in which the developer whose transport amount is regulated by the developer regulation member is transported in an opposite direction to the photoconductor move direction in a developing area and next developing is performed by the developing roller with the sleeve roller rotating in the direction in which the developer whose transport amount is regulated by the developer regulation member is transported in the same direction as the photoconductor move direction in a developing area.

* * * * *